US006612364B2

(12) United States Patent
Streubel

(10) Patent No.: US 6,612,364 B2
(45) Date of Patent: Sep. 2, 2003

(54) CONTINUOUS CASTING METHOD WITH SOFT REDUCTION

(75) Inventor: Hans Streubel, Erkrath (DE)

(73) Assignee: Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 09/804,414

(22) Filed: Mar. 9, 2001

(65) Prior Publication Data

US 2001/0020528 A1 Sep. 13, 2001

(30) Foreign Application Priority Data

Mar. 10, 2000 (DE) ..... 100 11 689

(51) Int. Cl.[7] ..... B22D 11/00
(52) U.S. Cl. ..... 164/476; 164/417
(58) Field of Search ..... 164/476, 417

(56) References Cited

U.S. PATENT DOCUMENTS 4,519,439 A 5/1985 Fredriksson et al.
5,348,074 A 9/1994 Streubel
5,577,548 A * 11/1996 Hohenbichler et al. ..... 164/417
6,102,101 A * 8/2000 Hanazaki et al. ..... 164/154.1

FOREIGN PATENT DOCUMENTS

| | | |
|---|---|---|
| DE | 41 38 740 A1 | 5/1993 |
| DE | 41 38 740 | 5/1993 |
| DE | 44 36 328 | 4/1995 |
| DE | 43 38 805 | 5/1995 |
| EP | 0 177 796 | 4/1986 |
| EP | 0 834 364 A2 | 4/1998 |
| EP | 0 834 364 | 4/1998 |

* cited by examiner

*Primary Examiner*—Kuang Y. Lin
(74) *Attorney, Agent, or Firm*—Herbert Dubno

(57) ABSTRACT

A continuous slab casting method whereby upstream of a soft reduction portion of a path of the strand and preferably downstream of a liquid core reduction portion, the strand is allowed to bulge by ferrostatic pressure of the liquid core, the bulge being pressed back during the soft reduction stage.

7 Claims, 1 Drawing Sheet

CONTINUOUS CASTING METHOD WITH SOFT REDUCTION

FIELD OF THE INVENTION

The present invention relates to a continuous slab casting method, especially for thin slabs, in which a soft reduction is effected. More particularly this invention relates to a continuous casting method for slabs and especially thin slabs in which the path of the metal from below the mold includes a plurality of strand-guide segments with adjustable gaps between opposite sides, usually formed by roller pairs and whereby to reduce segregation and core porosity, the cast strand is subjected to a reduction in thickness in the region of residual solidification by appropriate adjustment of the opening between the opposite sides of the respective strand guide segment.

BACKGROUND OF THE INVENTION

In the method described in DE 41 38 740 A1 and U.S. Pat. No. 5,348,074, the strand is subjected to soft reduction in a portion of its path prior to full hardening, the slab entering that segment or zone before it is hardened through its thickness and leaving that zone when it is fully hardened. That requires particular care with respect to the casting velocity. In the region of final hardening, the thickness reduction, for example, for thin slabs is between 0.5 and 3 mm per meter of the slab length. The roller pair of the segments through which the strand passes are thus progressively more closely spaced in the soft reduction region so as to improve the internal quality of the strand in the residual hardening region.

EP 0 834 364 describes a method of and an apparatus for high speed continuous casting with a thickness reduction during hardening, whereby the melt is cast into an oscillating mold and the strand cross section is linearly reduced in thickness over a minimum length of the strand guide directly following the mold. Thereafter a further reduction in the thickness of the strand is effected over the remainder of the strand guide by soft reduction until the most immediately before final solidification or the liquidus tip. The liquidus tip or liquidus part is the point at which the liquid core ends and at which thereafter, the slab is fully solidified. In this system, the degree of deformation of the cross sectional reduction of the strand is such that the critical deformation of the strand shell (solidified material surrounding the liquid core) for a given high casting speed and steel quality, should not be exceeded.

EP 0 177 796 B1 discloses a method of guiding and straightening a cast strand in the straightening an outlet region of an arcuate continuous caster, whereby opposite rollers of the segments are biased by a spring force against the ferrostatic pressure within the strand, the rollers being spaced apart at a distance corresponding to the thickness of the strand as it emerges from the mold. This region of the guide is followed by a region in which the strand is compressed to a greater extent and over these regions the spring force is reduced. In this technique, the gap between opposite sides of the guide and thus the spacing of the opposite rollers can be adjusted in a stepless manner by hydraulic cylinders and servovalves using inductive displacement measurements based upon the computer-determined or measured location of the liquidus tip.

The slabs or billets resulting from the processes described and produced by continuous casting are starting materials for rolled products, especially for the production of strip or plates in the rolling mill.

In continuous casting and especially the continuous casting of thin slabs, the aforementioned soft reduction can reduce segregation in the strand and produce a relatively optimum lattice or grain structure in the solidified slab when the thickness reduction immediately upstream of the liquidus point is between 0.5 and 3 mm per meter of the strand. The upper yokes of the strand guide can thus have their rollers mounted with an inclination between the inlet and outlet sides so that the guides provided a smaller mouth width or clear opening at the outlet side than at the inlet side. In many cases, the already solidified edge portions of the strand are subjected to further reduction by the rollers of the strand guides. This can give rise to an unnecessary increase in the stressing of the rollers and their bearings without positively affecting the internal quality of the slab structure in the edge regions.

OBJECTS OF THE INVENTION

It is an object of the invention to provide a more effective method of improving the internal structure of a continuously cast slab and especially a continuously cast thin slab which is to undergo soft reduction in the manner described, but without the increased roller and bearing loading hitherto encountered.

Another object of the invention is to provide an improved method of continuously casting slabs and especially thin slabs which will allow the thickness reduction to act on the central part of the strand, sparing the already hardened edge regions from the thickness reduction action.

Still another object of this invention is to provide an improved method of producing continuously cast slabs in which soft reduction is used without the heavy wear of the rollers and bearings characterizing earlier systems.

SUMMARY OF THE INVENTION

These objects and others which will become apparent hereinafter are attained, in accordance with the invention in that the cast strand, upstream of the end of the soft reduction zone is permitted to bulge by a corresponding opening or gap between the opposite sides or rollers of a guide segment by ferrostatic internal pressure and the bulge is then completely or partly pressed back down in the soft reduction stretch to the slab thickness which is maintained in the residual solidification region.

More particularly, a continuous slab casting method can comprise the steps of:

(a) continuously casting a molten metal into a continuous casting mold and solidifying a shell of the metal around a liquid core in a solidifying strand emerging downwardly from the mold;

(b) passing the solidifying strand in succession through a plurality of strand guide segments each having an adjustable gap between opposite sides thereof thereby applying compression to opposite sides of the solidifying strand to reduce a thickness thereof by soft reduction to limit segregation and core porosity in the slab produced over a soft-reduction portion of a path of the strand immediately upstream from a liquid-core tip representing a boundary between full solidification and partial solidification of the strand;

(c) upstream of the soft-reduction portion of the path increasing the gap between the opposite sides of at least one of the strand guide segments from the gap between a more upstream strand guide segment to produce a bulge in the shell as a result of internal ferrostatic pressure on the shell; and (d) pressing the bulge inwardly to a slab thickness in the soft-reduction portion of the path.

The bulging which is permitted, referred to here as targeted bulging since the extent thereof is controlled, is determined by the corresponding setting of the width of the guide upstream of the soft reduction zone and thus the mouth width or roller spacing in the bulging region. Only in the soft reduction zone is the bulge completely or partly pressed back to the strand thickness which prevails at residual solidification.

By comparison with the earlier approaches, for the same thickness reduction and core compaction, a reduced compaction force is required with the invention and the roller and bearing loading is reduced.

This allows the support structure for the guide segments to be less complicated and dimensioned so as to be smaller while enhancing strand quality in terms of reduction of segregation and core porosity. If a force similar to that used in earlier systems can be maintained, greater thickness reduction and core compaction can be achieved.

According to a feature of the invention, the cast strand prior to reaching the soft reduction zone is initially subjected to a compaction by reduction in the mouth width of a respective guide segment and while a substantial core of liquid is present in a form of liquid-core reduction and only thereafter, in a subsequent zone upstream of the soft reduction region, is the strand permitted to bulge by ferrostatic pressure and a widening of the mouth width. The soft reduction is effected in a further guide segment to the liquidus point previously described.

The mouth width of the segments can be parallel to the sides of the strand or at an inclination to the sides of the strand and upstream of the soft reduction zone can linearly increase or nonlinearly increase.

In the production of thin slabs, the enlargement of the mouth width beyond the width of the strand can be between 1 and 8 mm and in the production of slabs which are not thin slabs, that enlargement can be between 3 and 20 mm.

The strand can initially pass through a parallel stretch directly below the mold in at least a first segment, followed by the liquid core reduction, bulge and soft reduction segments.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
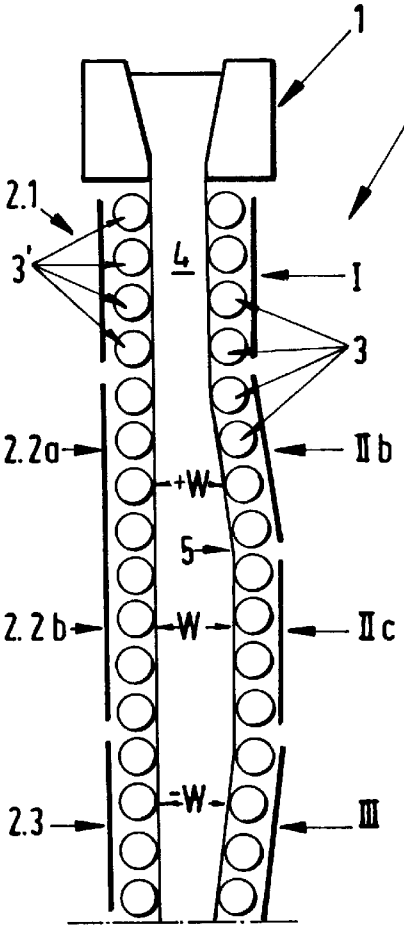
FIG. 1 is a highly diagrammatic illustration of the guide segments below a continuous casting mold according to the invention in which a soft reduction zone follows the targeted bulging zone.

FIG. 1 shows a continuous casting mold 1 above a plurality of strand guide segments 2.1, 2.2, 2.3 each of which consists of a pair of segments on opposite sides of the strand 4, each having a plurality of rollers 3, 3' which are disposed opposite one another in pairs defining the gap or opening of the segment through which the strand passes.

The segment 2.2 is subdivided into the segments sections 2.2*a* and 2.2*b*.

The gap between the rollers of each pair can be adjusted by adjusting the relative positions of the segment halves via hydraulic units known in the art (see, for example, U.S. Pat. No. 5,348,074).

To avoid segregation in the strand 4 during the solidification and to insure a compact internal structure of the slab, a soft reduction zone III is provided in the strand guide 20 in the region of the final solidification. At the lowest point in this zone III, the thickness of the strand has been reduced to that of the continuously cast slab or thin slab as desired and this point can correspond to the liquidus point previously mentioned. In the soft reduction zone III the thickness reduction is 0.5 to 3 mm per meter.

In the embodiment of FIG. 1, the strand 4, prior to reaching the soft reduction zone III is permitted to bulge outwardly at 5 by an appropriate adjustment of the spacing between the rollers 3, 3' of each pair.

The bulge 5 is then reduced by a corresponding conical (wedge-shaped) roller arrangement in the soft reduction stretch III to the strand thickness which is to be achieved at final solidification.

With this bulge formation in the regions IIb and IIc by appropriate spreading of the segments 2.2*a* and 2.2*b*, the segregation can be reduced and the compaction of the internal structure of the slab can be assured without the excessive roller and bearing loading at the edges resulting from complete solidification there. The rollers in the regions 2.2*a*, 2.2*b* and 2.3, effectively act on the bulging central portion of the strand and the edge portions which have already fully solidified are not compacted by the rollers.

Figure 2:
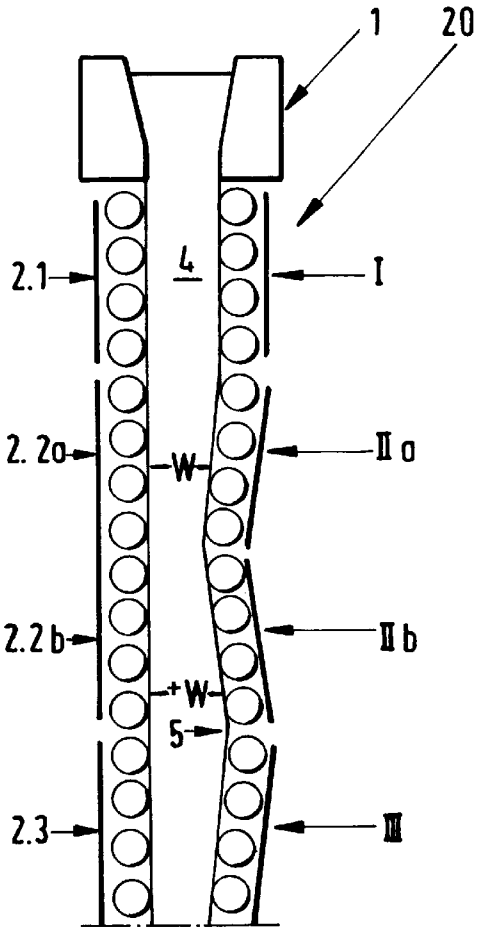
FIG. 2 is a view similar to FIG. 1 but with a system in which a liquid core reduction stretch precedes the targeted bulge forming zone.

In the embodiment of FIG. 2, the cast strand 4 is provided upstream of the soft reduction zone III by adjustment of the mouth width (W) of the rollers 3, 3', with a certain slab thickness in an initial parallel stretch I directly below the mold 1 in at least 1 first guide segment 2.1. In a subsequent or following segment 2.2, an initial compression is provided, e.g. in the region IIa over the segment portion 2.2*a* by a reduction in the mouth width (−W) to effect a liquid-core reduction to a slab thickness less than the certain slab thickness of the parallel stretch I. The guide path then widens in the region IIb to a mouth width (+W), greater than W and greater than the outlet width of the mold, to form the bulge in the region IIb in the further segment 2.2 and with a thickness of the slab greater than the certain thicknesses and the thickness on liquid-core reduction in zone III.

From the maximum bulge location represented at 5 in FIG. 2, the strand undergoes soft reduction in the zone III in at least one further segment 2.3 until the liquidus point is reached, whereupon the slab is at its final thickness. The enlarged mouth region (+W) is thus a zone IIb between the liquid core reduction at IIa and the soft reduction at III.

According to a feature of the invention, the width (W) upstream of the soft reduction region III can increase linearly. Alternatively, it maybe advantageous to provide a nonlinear bulging.

It is advantageous for the production of thin slabs to avoid a critical deformation of the shell of the strand surrounding the liquid core by providing the increase in the mouth width so that it will be between 1 and 8 mm.

With the continuous casting of slabs which are thicker than thin slabs and thus may be of a thickness of 250 mm and more, the widening (+W) in the bulge region can be between 3 and 20 mm.

Figure 3:
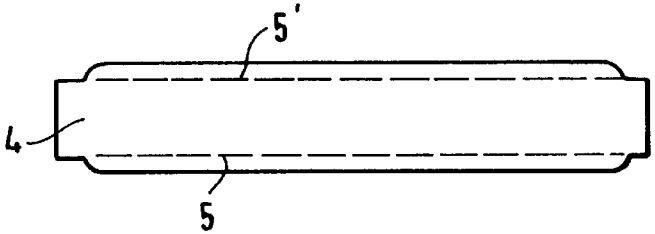
FIG. 3 is a cross section of a strand.

FIG. 3 shows the cast strand in cross section. The bulges 5 on either side are obtained by an increased setting of the mouth of the respective guide segment upstream of the soft reduction zone III. This bulge 5 is pressed fully or partially back in during the soft reduction zone III. The solid lines in FIG. 3 show the contour of the bulging strand. The broken lines 5' show the contour of the strand after it leaves the soft reduction zone.

I claim:

1. A method of casting a continuous slab with reduced segregation and core porosity, said method comprising the steps of:

(a) continuously casting a molten metal into a continuous casting mold and solidifying a shell of said metal around a liquid core in a solidifying strand emerging downwardly from said mold at a certain thickness;

(b) passing the solidifying strand through a succession of strand guide segments each consisting of two groups of multiple guide rollers on opposite sides of the strand and flanking the strand to define a width of a path of the strand between the groups and thereby control a thickness of the strand between the respective groups of rollers;

(c) in a first strand guiding stage immediately downstream of said mold guiding said strand in a parallel stretch through at least one of said strand guide segments with a certain slab thickness;

(d) spaced downstream of said first strand guiding stage and in a soft reduction stage with convergence in at least one of said strand guide segments compressing said strand at least partially to a finished slab thickness and with said soft reduction stage extending at least to a liquidus point between said liquid core and full solidity of the strand;

(e) upstream of said soft reduction stage and downstream of said first strand guiding stage, in a second strand guiding stage and between converging strand guides of at least one of said strand guide segments over a region in which said core of said strand remains liquid, effecting liquid-core reduction of said strand to a thickness less than said certain thickness; and (f) upstream of said soft reduction stage and in a third strand guiding stage and between diverging strand guides of at least one of said strand guide segments over a region in which said core of said strand remains liquid, effecting ferrostatic liquid-core expansion of said strand to a thickness greater than said certain thickness and greater than the thickness of said strand upon said liquid-core reduction, thereby forming a bulge, said strand subsequent to said ferristatic liquid-core expansion being subjected to said soft-reduction stage whereby said bulge is pressed in.

2. The method defined in claim 1 wherein the mouth width of at least one of said segments upstream of said soft reduction portion of said path is increased to a spacing greater than the outlet thickness of the strand at an outlet end of said mold.

3. The method defined in claim 1 wherein the mouth width setting of one of said segments is parallel to or conical with respect to said strand.

4. The method defined in claim 1 wherein the mouth width of a segment upstream of said soft reduction portion linearly increases.

5. The method defined in claim 1 wherein the mouth width of a segment upstream of said soft reduction portion non-linearly increases.

6. The method defined in claim 1 for the production of a thin slab wherein a mouth width of said one of said guide segments increases between 1 and 8 mm to form said bulge.

7. The method defined in claim 1 for the production of slabs having a thickness of at least 250 mm, wherein a mouth width of said one of said strand guide segments increases between 3 and 20 mm to produce said bulge.

* * * * *